US005301618A

United States Patent [19]

Abendschein et al.

[11] Patent Number: 5,301,618

[45] Date of Patent: Apr. 12, 1994

[54] GUIDE MEANS FOR CONVEYING SHEET-SHAPED MEDIA

[75] Inventors: Ulrich Abendschein, Herrenberg; Friedrich Schlegel, Moessingen, both of Fed. Rep. of Germany

[73] Assignee: International Business Machines Corporation, Armonk, N.Y.

[21] Appl. No.: 925,952

[22] Filed: Aug. 5, 1992

[30] Foreign Application Priority Data

Dec. 17, 1991 [DE] Fed. Rep. of Germany ..... 4141530

[51] Int. Cl.[5] ..... E05G 1/02

[52] U.S. Cl. ..... 109/55; 198/624; 194/206

[58] Field of Search ..... 198/624; 232/16, 15, 232/10, 7; 194/206, 207; 109/55, 24.1, 66

[56] References Cited

U.S. PATENT DOCUMENTS

| | | | |
|---|---|---|---|
| 2,677,473 | 5/1954 | Piggott et al. | 198/624 |
| 3,005,537 | 10/1961 | Schmeck et al. | 198/624 |
| 3,442,363 | 5/1969 | Riddle et al. | 194/206 |
| 3,719,266 | 3/1973 | Korn et al. | 198/624 |
| 3,836,980 | 9/1974 | Grosswiller, Jr. et al. | 109/66 |
| 4,355,711 | 10/1982 | Hirose | 194/4 C |
| 4,510,381 | 4/1985 | Fukatsu | 109/24.1 |
| 4,678,178 | 7/1987 | Akiyama et al. | 198/624 |
| 4,884,679 | 12/1989 | Graef et al. | 109/55 |

FOREIGN PATENT DOCUMENTS

| | | |
|---|---|---|
| 0197722 | 3/1986 | European Pat. Off. . |
| 2656289 | 12/1989 | France . |

*Primary Examiner*—Peter M. Cuomo
*Assistant Examiner*—Darnell M. Boucher
*Attorney, Agent, or Firm*—Perman & Green

[57] ABSTRACT

A guide is shown for connecting two separately arranged transfer units, in particular currency transfer units in banking machines, which are shiftable relative to each other. The guide comprises a non-resilient and a resilient guide element, both of which form a guide channel between the transfer units. The guide channel is conically tapered both in and opposite to the transfer direction. This allows a transfer of sheet-shaped media both forward and backward. The resilient guide element's interaction with the non-resilient guide element, when engaged, leads to a self-alignment of the transfer units.

8 Claims, 3 Drawing Sheets

GUIDE MEANS FOR CONVEYING SHEET-SHAPED MEDIA

DESCRIPTION

1. Field of the Invention

The invention relates to a guide means for conveying sheet-shaped media, in particular bank notes, between two transfer units which are independent of and arranged to be shiftable relative to each other, comprising at least two guide elements positioned between the transfer units and forming a conically tapered channel in the transfer direction for guiding sheet-shaped media.

2. Background of the Invention

Guide means of this type are employed in banking machines, such as IBM 4731 (see, for example, Parts catalog "IBM 4731" Personal Banking Machine Form No. SY19-6189-06). For conveying bank notes from the transfer unit mounted in a safe to the transfer unit arranged outside said safe, a guide means is required for accurately handling the currency. A rigid connection between the inner and the outer transfer unit is not expedient, as the safe-mounted transfer unit is not expedient, as the safe-mounted transfer unit has to be horizontally displaced for loading the currency cassettes. In addition, vertical height differences may occur between the safe and the outer and the inner transfer unit, which have to be compensated for.

The guide means currently used in IBM banking machines are fitted at the bottom and the top end of the transfer path of the inner and the outer transfer unit with a channel which is conically tapered in the transfer direction. A disadvantage of this is that the conically tapered channel allows the bank notes to be moved forward only. Another disadvantage is that such guide means are incapable of compensating for vertical height differences caused by faulty manufacturing tolerances between the transfer units. As a result, the bank notes become trapped between the transfer units, thus rendering the banking machine unserviceable. In order to prevent this, a foil is arranged between the transfer units. However, such foils have the disadvantage of becoming damaged or destroyed in the course of time, as the machine has to be horizontally displaced for loading the currency cassettes.

SUMMARY OF THE INVENTION

The present invention provides a guide means between separately arranged transfer units, which are shiftable relative to each other, such that the sheet-shaped media may be transferred both forward and backward and that the transfer units are automatically alignable relative to each other. The backward transfer feature allows the bank notes to be reliably returned to the safe. This eliminates expensive containers for storing the bank notes outside the safe. The resilient and the non-resilient guide means are designed such that the associated transfer units are reliably automatically aligned without any manual intervention. In addition, the resilient guide means compensates for space differences, so that the currency is accurately conveyed between the associated transfer units Additional foils for guiding the currency are thus dispensed with. One way of carrying out the invention is described in detail below with reference to drawings which illustrate only one specific embodiment in conjunction with a banking machine, in which:

DETAILED DESCRIPTION OF THE INVENTION

Figure 1:
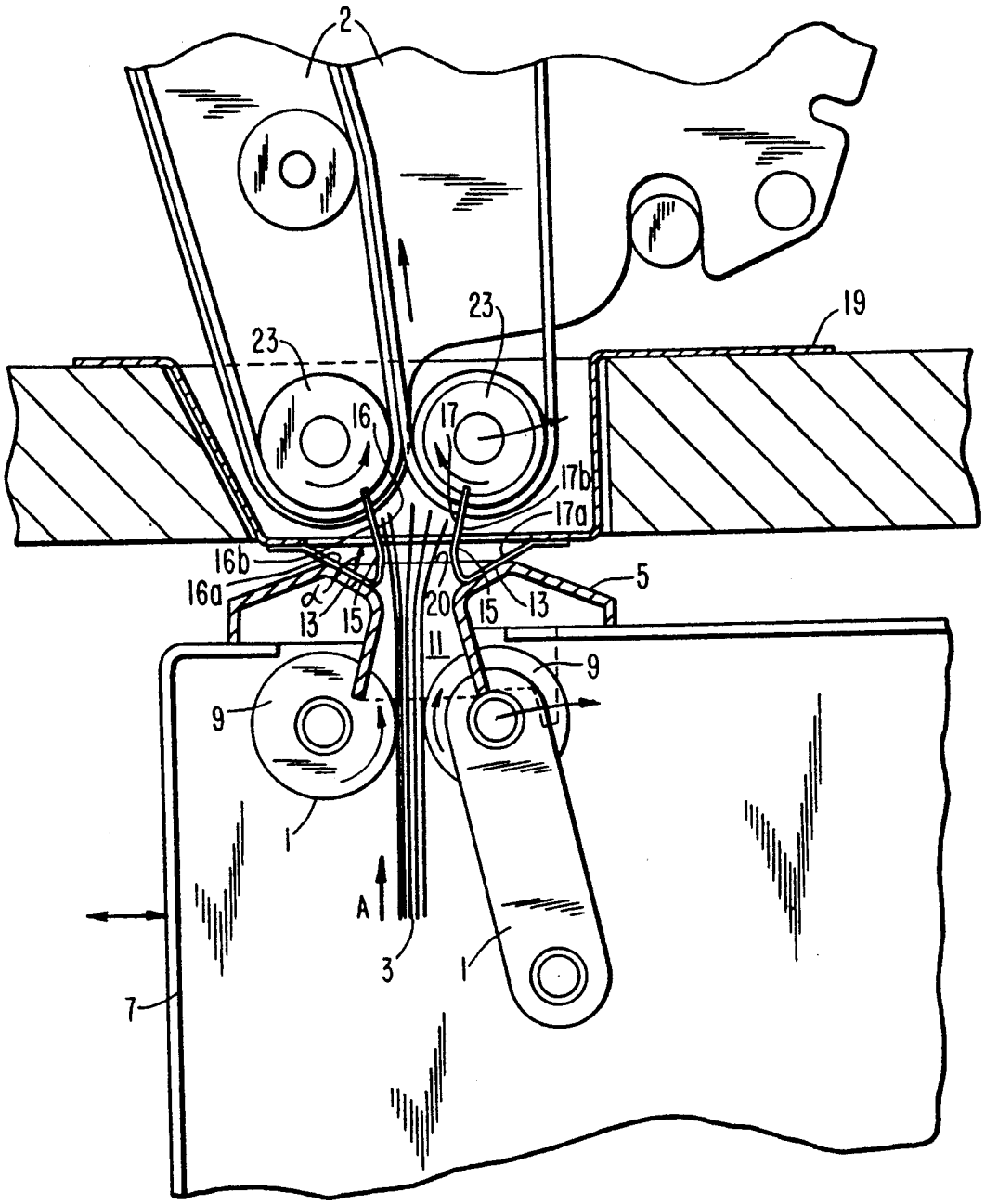
FIG. 1 is a sectional view of the associated transfer units with the guide means according to the invention in the forward transfer mode.

According to FIG. 1, the two transfer units 1 and 2 are in their operating position. A bank note stack 3 is positioned in the safe-mounted unit 7 such that it may be taken over by transfer unit 1. Friction drives are preferably used. The transfer rollers 9 in the lower portion of the friction drive are positioned to withdraw against spring tension, withdrawal taking place by the rollers being moved about a pivot or being horizontally displaced. The note stack 3 is guided by transfer rollers 9 in a conically tapered channel 11 of the non-resilient guide element 5. As the bank notes tend to drift apart upon leaving the transfer rollers 9, the conical channel 11 of the guide element 5 must extend at least into the area of the transfer rollers 9. This prevents the individual notes from becoming wrapped around the transfer rollers 9 or from escaping in the area between rollers 9 and non-resilient guide element 5. The non-resilient guide element 5 is positioned relative to transfer units 1, 2 such that the conical channel 11 in the non-resilient guide element 5 is tapered in the transfer direction A. Adjacent to the conically tapered channel 11 in the non-resilient guide element 5, a ramp-shaped detent 13, protruding from channel 11, is arranged on either side and horizontally to transfer direction A. This detent is subsequently lowered in ramp shape.

A resilient guide element 15 preferably consists of two separately acting resilient elements 16, 17 which are fixed to a common holding means 19. The individual resilient elements 16, 17 consist of two legs which are preferably arranged in V-shape relative to each other. The resilient elements 16, 17 are arranged vertically to transfer direction A such that facing legs **16*b*, 17*b* form a conically tapered channel 20 opposite to the transfer direction A. The legs 16*a*, 17*a* of the elements 16 and 17, which are averted from each other, are resiliently supported on the holding means at an angle $\alpha$. The averted resilient legs 16*a*, 17*a* act as resilient stop levers which become engaged only after guide elements 5, 15 are in alignment. When the two transfer units 1, 2 are aligned to each other, the averted legs 16*a*, 17*a* rest on the ramp-shaped detent 13 of the non-resilient guide element 5, normally exerting a back-up force on the ramp-shaped detent 13. The facing legs 16*b*, 17*b* extend into the area of the transfer rollers 23 of the top transfer unit 2, preventing bank notes from escaping between transfer rollers 23 and resilient guide elements 16, 17. The averted resilient legs 16*a*, 17*a* act as resilient stop levers which become engaged only after the guide elements 5, 15** are in alignment.

Figure 2:
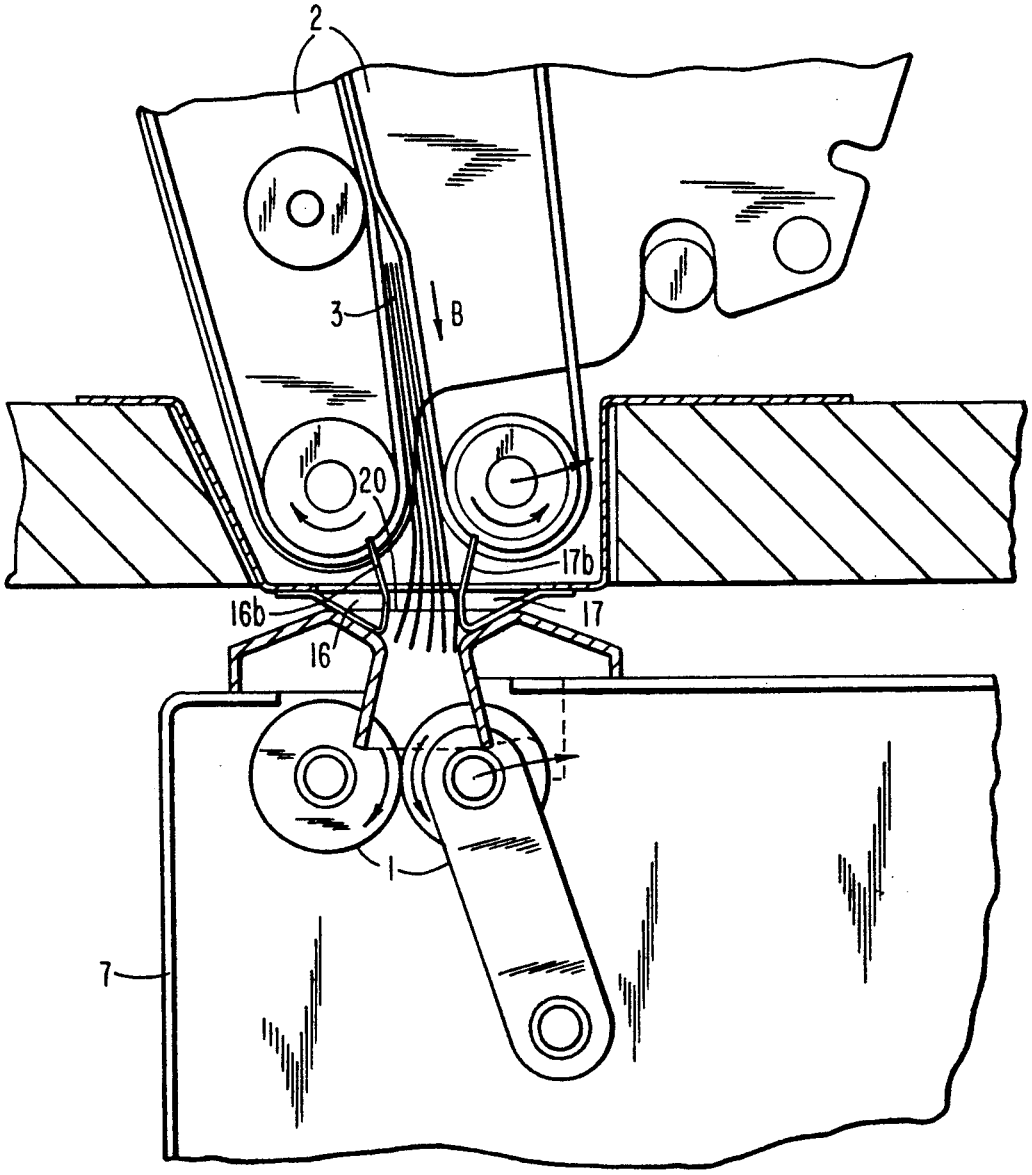
FIG. 2 is a sectional view of the associated transfer units with the guide means according to the invention in the backward transfer mode; and, FIG. 3 is a sectional view of the associated transfer unit with the guide means according to the invention at a stage where the transfer units are not aligned relative to each other.

FIG. 2 shows the inventive means during the backward transfer of a note stack 3. Bank notes that are not picked up by the customer are returned to the safe. Transfer unit 2, by which the currency to be dispensed is transferred forward, also handles the backward transfer. The conically tapered channel 20, which is formed by the two resilient elements 16, 17, ensures that the individual backward-transferred bank notes of stack 3 do not drift apart or become entangled in channel 20, which, as a rule, would interfere with the function of the banking machine. As the individual legs 16*b*, 17*b* of the resilient elements 16, 17 extend into the area of the transfer rollers 23 of the transfer unit 2, the individual bank notes are prevented from laterally escaping while they are being conveyed from transfer unit 2 to the resilient guide element 15.

Figure 3:
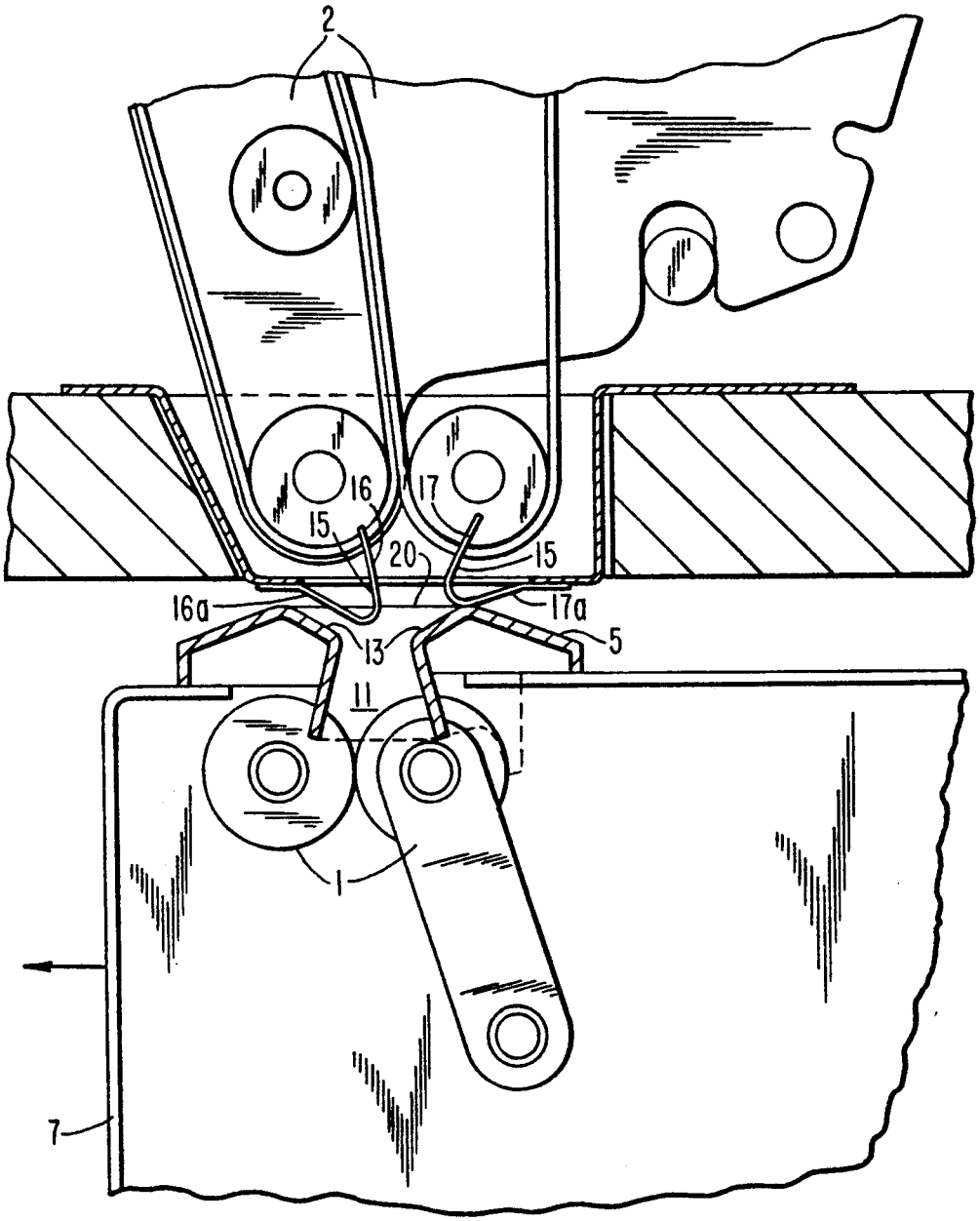

FIG. 3 shows the guide means according to the invention in a position where the transfer units 1, 2 are not aligned to each other. This position is assumed whenever unit 7 is loaded with currency. As unit 7 resumes an aligned position in which transfer of the currency is guaranteed by the guide means according to the invention, the non-resilient guide element 5 by its ramp-shaped detent 13 urges the resilient guide element 15 in the transfer direction A, so that a bias is exerted on the non-resilient guide element 5. This bias causes the averted legs 16*a*, 17*a* to become engaged on detent 13 of the non-resilient guide element 5 when the transfer units 1, 2 are in alignment with each other.

Another embodiment provides for the guide elements 5, 15 to be resiliently designed, with their spring constants differing, so that the guide elements 5, 15 are capable of engagement.

Yet another embodiment provides for the guide elements 5, 15 to be non-resiliently designed. For this purpose, at least one guide element must be supported by one or several springs.

The resilient elements 16, 17 adapt to different spacings, thus ensuring that channel 11 and channel 20 form a largely enclosed guide channel for guiding the currency y between the transfer units 1, 2, without manual adjustment being required.

Guide elements 5, 15 are preferably made of stainless steel to minimize their wear resulting from currency led past them.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. A guide assembly for conveying sheet-shaped media, comprising:

a first transfer unit and a second transfer unit, said first transfer unit and second transfer unit mounted to be relatively shiftable with respect to each other;

a first guide element having legs coupled about an aperture in said first transfer unit, said legs positioned in a converging manner to form a first channel in a sheet transfer direction from said first transfer unit; and a second guide element having legs coupled about an aperture in said second transfer unit, said legs positioned to form a second channel and arranged in a converging manner oppositely directed to said legs of said first guide element, said first guide element and second guide element being engaged to form a substantially enclosed guide channel comprising said first and second channels between said first transfer unit and second guide element comprised of a resilient material so as to maintain said enclosed guide channel in the event of relative shifting between said first transfer unit and second transfer unit.

2. A guide assembly according to claim 1, wherein one said guide element is non-resilient.

3. A guide assembly according to claim 2, wherein said resilient guide element comprises two individual resilient elements arranged relative to each other to form a channel.

4. A guide assembly according to claim 3, wherein each said individual resilient element has first and second leg portions arranged in a V-shape, the first leg portions in said resilient guide element facing each other to form said channel, and the second leg portions in said resilient guide element averted from each other and resiliently arranged to act as a resilient stop lever when in engagement with said non-resilient guide element.

5. A guide assembly according to claim 4, wherein said non-resilient guide element, on a side facing said resilient guide element, is arranged to form a detent about said channel, said detent being ramp-shaped and surrounding said second leg portions of said resilient guide element when said resilient guide means is aligned with said non-resilient guide means.

6. A guide assembly according to claim 5, wherein said second leg portions of said resilient guide element rest against said detent with a predetermined bias when the first and second transfer units are aligned to each other.

7. A guide assembly according to claim 6 wherein said guide elements are comprised of stainless steel.

8. A guide assembly in accordance with claim 6 wherein said two transfer units are portions of a banking machine, said transfer units provided with a communicating guide means including said guide elements.

* * * * *

UNITED STATES PATENT AND TRADEMARK OFFICE

CERTIFICATE OF CORRECTION

PATENT NO. : 5,301,618

DATED : April 12, 1994

INVENTOR(S) : Abendschein et al.

It is certified that error appears in the above-identified patent and that said Letters Patent is hereby corrected as shown below:

In col. 4, claim 1, line 17, after the word "second", the phrase --transfer unit, at least said first guide element or second-- should appear.

Signed and Sealed this

Twenty-sixth Day of July, 1994

Bruce Lehman

*Attest:*

BRUCE LEHMAN

*Attesting Officer*

*Commissioner of Patents and Trademarks*